US006657532B1

(12) United States Patent
Shrier et al.

(10) Patent No.: US 6,657,532 B1
(45) **Date of Patent: *Dec. 2, 2003**

(54) SINGLE AND MULTI LAYER VARIABLE VOLTAGE PROTECTION DEVICES AND METHOD OF MAKING SAME

(75) Inventors: Karen P. Shrier, Fremont, CA (US); Gerald R. Behling, San Jose, CA (US); James B. Intrater, Santa Clara, CA (US); Kailash C. Joshi, Milpitas, CA (US); William W. Alston, Jr., Sunnyvale, CA (US)

(73) Assignee: SurgX Corporation, San Jose, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 766 days.

(21) Appl. No.: 09/139,309

(22) Filed: Aug. 24, 1998

Related U.S. Application Data

(62) Division of application No. 08/841,475, filed on Apr. 21, 1997, now Pat. No. 5,807,509, which is a continuation of application No. 08/275,154, filed on Jul. 14, 1994, now abandoned.

(51) Int. Cl.[7] ..... H01C 7/10

(52) U.S. Cl. ..... 338/21; 204/205; 204/101

(58) Field of Search ..... 338/20, 21, 204, 338/205, 101; 361/127, 128

(56) References Cited

U.S. PATENT DOCUMENTS

| | | | | | |
|---|---|---|---|---|---|
| 1,509,496 | A | * | 9/1924 | Slepian | 338/204 |
| 1,873,362 | A | * | 8/1932 | Tanberg | 338/21 |
| 2,295,379 | A | * | 9/1942 | Beck et al. | 338/21 |
| 3,310,766 | A | * | 3/1967 | Downing et al. | 338/20 |
| 4,041,436 | A | * | 8/1977 | Kouchich et al. | 338/21 |
| 5,008,646 | A | * | 4/1991 | Hennings et al. | 338/20 |
| 5,278,535 | A | * | 1/1994 | Xu et al. | 338/20 |
| 5,476,714 | A | * | 12/1995 | Hyatt | 338/21 |

FOREIGN PATENT DOCUMENTS

| | | | | |
|---|---|---|---|---|
| JP | 2-10701 | * | 1/1990 | 338/21 |
| WO | 80/06859 | * | 7/1989 | 338/21 |

* cited by examiner

*Primary Examiner*—Karl D. Easthom
(74) *Attorney, Agent, or Firm*—Burns, Doane, Swecker & Mathis, LLP

(57) ABSTRACT

Disclosed is a variable voltage protection device for electronic devices which in one aspect comprises a thin layer of neat dielectric polymer or glass positioned between a ground plane and an electrical conductor for overvoltage protection, wherein the neat polymer or glass layer does not include the presence of conductive or semiconductive particles. Also disclosed is the combination of the neat dielectric polymer or glass thin layer positioned on a conventional variable voltage protection material comprising a binder containing conductive or semiconductive particles. A multi-layer variable voltage protection component is disclosed comprising three layers of overvoltage protection material wherein the outer two layers contain a lower percentage of conductive or semiconductive particles and wherein the inner layer contains a higher percentage of conductive or semiconductive particles. The multi-layer component can optionally be used in combination with the neat dielectric polymer or glass layer and can optionally have interposed metal layers. A method is disclosed for dispersing insulative particles and conductive or semiconductive particles in a binder using a volatile solvent for dispersement of the insulative particles and the conductive or semiconductive particles before mixing with the binder.

5 Claims, 1 Drawing Sheet

SINGLE AND MULTI LAYER VARIABLE VOLTAGE PROTECTION DEVICES AND METHOD OF MAKING SAME

This application is a divisional, of application Ser. No. 08/841,475 filed on Apr. 21, 1997, now U.S. Pat. No. 5,807,509, which is continuation of application Ser. No. 08/275,154 filed on Jul. 14, 1994, now abandoned.

FIELD OF THE INVENTION

The present invention relates generally to variable voltage protection devices used to protect electronic circuits from overvoltage transients caused by lightning, electromagnetic pulses, electrostatic discharges, ground loop induced transients, or inductive power surges. The present invention relates particularly to materials of construction for variable voltage protection components and methods of making variable voltage protection components and devices.

BACKGROUND OF THE INVENTION

Voltage transients can induce very high currents and voltages that can penetrate electrical devices and damage them, either causing hardware damage, such as semiconductor burnout, or electronic upset, such as transmission loss or loss of stored data. The voltage transients produce large voltage spikes with high peak currents (i.e, overvoltage). The three basic overvoltage threats are electrostatic discharge, line transients, and lightning. Electrostatic discharge typically occurs when static charge dissipates off the body of a person in direct physical contact with an operating electronic system or an individual component, such as an integrated circuit chip. Line transients are surges in AC power lines. Line transients can also occur due to closing a switch or starting a motor. Lightning strikes can strike stationary objects, such as a building, or mobile objects such as aircraft or missiles. Such strikes can suddenly overload a system's electronics. At peak power, each of these threats is capable of destroying the sensitive structure of an integrated circuit chip.

Various overvoltage protection materials have been used previously. These materials are also known as nonlinear resistance materials and are herein referred to as voltage variable materials. In operation, the voltage variable material initially has high electrical resistance. When the circuit experiences an overvoltage spike, the voltage variable material quickly changes to a low electrical resistance state in order to short the overvoltage to a ground. After the overvoltage has passed, the material immediately reverts back to a high electrical resistance state. The key operational parameters of the voltage variable material are the response time, the clamp voltage, the voltage peak and peak power. The time it takes for the voltage variable material to switch from insulating to conducting is the response time. The voltage at which the voltage variable material limits the voltage surge is called the clamp voltage. In other words, after the material switches to conducting, the material ensures that the integrated circuit chip, for example, will not be subjected to a voltage greater than the clamp voltage. The voltage at which the voltage variable material will switch (under surge conditions) from insulating to conducting is the switch voltage. These materials typically comprise finely divided conductive or semiconductive particles dispersed in an organic resin or other insulating medium. For example, U.S. Pat. No. 3,685,026 (Wakabayashi, et al.), U.S. Pat. No. 4,977,357 (Shrier) and U.S. Pat. No. 4,726,991 (Hyatt et al.) disclose such materials.

Voltage variable materials and components containing voltage variable materials have been incorporated into overvoltage protection devices in a number of ways. For example, U.S. Pat. No. 5,142,263 and 5,189,387 (both issued to Childers et al.) disclose a surface mount device which includes a pair of conductive sheets and voltage variable material disposed between the pair of conductive sheets. U.S. Pat. No. 4,928,199 (Diaz et al.) discloses an integrated circuit chip package which comprises a lead frame, an integrated circuit chip protected by an electrode cover which is connected to ground on one side, and a variable voltage switching device including the voltage variable material connected to the electrode cover on the other side. U.S. Pat. No. 5,246,388 (Collins et al.) is directed to a device having a first set of electrical contacts that interconnect with signal contacts of an electrical connector, a second set of contacts that connect to a ground, and a rigid plastic housing holding the first and second set of contacts so that there is a precise spacing gap to be filled with the overvoltage material. U.S. Pat. No. 5,248,517 (Shrier et al.) discloses painting or printing the voltage variable material onto a substrate so that conformal coating with voltage variable material of large areas and intricate surfaces can be achieved. By directly printing the voltage variable material onto a substrate, the voltage variable material functions as a discreet device or as part of associated circuitry.

The above U.S. Patents referred to are incorporated herein by reference.

Although the prior art discloses various materials and devices, there is a continuing and long felt need to provide improved cost-effective voltage variable materials and devices of more consistent performance properties to prevent variations in the clamp voltage under various conditions in which the materials and devices are used.

SUMMARY OF THE INVENTION

This invention comprises in one aspect a variable voltage protection device which comprises a single layer of neat dielectric polymer or glass positioned between a ground plane and an electrical conductor of an electronic device. It has surprisingly been found that overvoltage protection can be effectively provided by such a polymer or glass layer, provided that the polymer or glass layer is sufficiently thin to provide the switching and the voltage clamping characteristics desired for a given protective device for a given electronic device. It has been found that for certain polymers the thickness must be less than about 1.6 mils and for other polymers the thickness must be less than about 0.8 mil, preferably less than about 0.5 mil and more preferably less than about 0.2 mil. For certain glasses the thickness must be less than about 1.6 mils, with thicknesses less than 0.8 mil preferred in many applications.

In another aspect of the present invention, it has been found that superior performance can be provided by a variable voltage protection component which comprises the combination of (a) a layer of variable voltage protection material comprising a binder containing conductive particles and/or semiconductive particles; and (b) a layer of neat dielectric polymer or glass in contact with one surface of said layer of variable voltage material; wherein the neat dielectric polymer or glass layer is present in a thickness of less than about 1.6 mils. It has been found that the presence of the thin layer of neat dielectric polymer or glass on the surface of the binder/particle type of variable voltage protection material provides a component having desirable voltage clamping properties, as well as other desirable properties.

In another aspect, this invention provides a layered variable voltage protection component comprising a first layer of variable voltage protection material comprising a binder having dispersed therein at least about 20% by volume of conductive or semiconductive particles; a second layer of variable voltage protection material in contact with the first layer comprising a binder having dispersed therein at least 40% by volume of conductive or semiconductive particles; and a third layer of variable voltage protection material in contact with said second layer comprising a binder having dispersed therein at least 20% by volume of conductive or semiconductive particles. It has been found that the multiple layer construction provides an opportunity to vary the conductor particle loading and/or semiconductor particle loading in each layer, such that the outer layers contain lower particle loadings than the inner layer, in order to achieve a wide range of clamping voltages and other desired properties. In an additional aspect of this invention, it has been found that the outer layer in contact with the electrical conductor of the electronic device should have a lower particle loading than the inner layer with a higher particle loading, but in such case the other outer layer in contact with the ground plane can be higher or lower in particle loading. In an additional aspect of this invention, this multi-layer variable voltage protection component can further be provided with a thin layer of the neat dielectric polymer or glass as referred to above on one outside surface or both outside surfaces, in order to provide additional properties and characteristics of the component. In this aspect of the invention, the layer on the side of the electrical conductor can have a higher or lower particle loading than the inner layer provided the neat dielectric polymer or glass layer is positioned between the outer layer and the electrical conductor. In another aspect of this invention this multiple layer component can be provided with a conductive, e.g., metal, layer interposed between the first layer and second layer and/or between the second layer and third layer of variable voltage protection material. In yet another aspect of this invention, these multiple layer components themselves can be stacked, with or without the outer layers of neat dielectric polymer or glass layers, and with or without an intervening layer of neat dielectric polymer or glass between components to achieve desired performance characteristics.

In another aspect, this invention provides a method of making a variable voltage protection material comprising forming a mixture comprising (a) conductive and/or semiconductive particles and (b) insulating particles in (c) a light organic solvent; mixing said mixture to disperse the insulating particles in the conductive/semiconductive particles; evaporating at least a portion, preferably all, of the solvent; and mixing the resultant mixture of conductive/semiconductive particles and insulating particles with a binder to form a variable voltage protection material.

DETAILED DESCRIPTION OF THE INVENTION

Referring to the first aspect of this invention which comprises a variable voltage protection device comprising as the variable voltage protection material a thin layer of a neat dielectric polymer or glass, it has been found that such a device is surprisingly effective at a desired range of clamping voltages provided that the layer of neat dielectric polymer or glass is sufficiently thin. It has been found that for some polymers a layer of less than about 0.8 mil will provide effective overvoltage protection under various conditions, while for other polymers a layer of less than about 1.6 mils provides the desired performance characteristics. It is preferable in many variable voltage protection applications that the polymer layer be less than about 0.5 mil and more preferably less than about 0.2 mil. Similarly, when the layer is a glass it is preferred that the layer be less than about 0.8 mil, but for some glasses in certain applications a thickness of up to about 3.8 mils is appropriate. As will be appreciated by one skilled in the art, the actual thickness of the neat dielectric polymer or glass layer employed in a particular variable voltage protection function will vary depending on the type of polymer or glass used, the operating conditions of the device in which the variable voltage protection element is employed and the performance properties required of the protection device.

Figure 1:
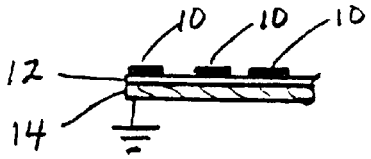
FIG. 1 is a cross-section view of an illustration of a variable voltage protection device incorporating a layer of neat dielectric polymer or glass.

FIG. 1 illustrates the device of this invention where layer 12 is positioned between electrical conductors 10 and ground plane 14.

As used in the disclosure and description of the present invention, the term "neat dielectric polymer or glass" refers to a polymeric or glass material which can act as a dielectric or insulating material under the normal voltage and current conditions of intended use and which is unfilled, i.e., does not contain conductive or semiconductive particles such as those typically used in binders or otherwise associated with variable voltage protection materials of the prior art. However, "neat dielectric polymer or glass" is intended to include polymeric or glass materials which fulfill the above criteria, but which may contain or have added to them insulative or inert particles or materials that are inactive or do not interfere with the desired dielectric/variable voltage protection properties of the polymer or glass layer as used in the present invention. The polymer or glass layer useful in the present invention can be formed or cured in situ or can be provided in a preformed or precured sheet or film and placed in position for use according to this invention. Additionally, the polymer layer can be a pre-cured polymer block from which sheets or layers of polymer can be sliced or shaved in the desired thickness. Further, the polymer or glass layer can be provided in the form of a mat of polymer or glass fibers or particles which are compressed or otherwise treated to provide the polymer or glass layer in the desired thickness and properties for use in this invention. Such a mat, which may contain an adhesive or binder for the fibers can be heated or heat treated while compressed to provide a sheet of polymer or glass fibers of desired thickness for use in this invention.

The polymers and glasses useful in this aspect of the invention can be selected from polymers known in the art to be useful as binders in conventional variable voltage protection materials to the extent that such polymers are known to have high resistance to tracking and high resistance to arcing. In addition, other polymers and glasses not previously suitable for or used as such binders are also useful in the present invention if they exhibit sufficient dielectric properties, sufficient resistance to tracking and sufficient resistance to arcing under the operating conditions selected for a device according to this invention.

In general, the types of polymers useful in the present invention include silicone rubber and elastomer, natural rubber, organopolysiloxane, polyethylene, polypropylene, polystyrene, poly(methyl methacrylate), polyacrylonitrile, polyacetal, polycarbonate, polyamide, polyester, phenol-formaldehyde resin, epoxy resin, alkyd resin, polyurethane, polyimide, phenoxy resin, polysulfide resin, polyphenylene oxide resin, polyvinyl chloride, fluoropolymer and chlorofluoropolymer. These and other useful polymers can be used by themselves or can include various substituent groups and can be mixtures, blends or copolymers thereof, wherein the final polymer is selected in accordance with the criteria described above. A particularly preferred polymer is a conventional and commercially available General Electric "615" silicone, and it is also particularly preferred to cure this polymer for about 15 minutes at about 200° C. to obtain properties better suited for use in this invention. In such a preparation, the curable liquid polymer is coated on the desired ground plane to the desired thickness, then cured as indicated. The cured polymer layer is then placed in contact with the electrical conductor(s) of an electronic device to form the variable voltage protection device of this invention.

It has been found that this polymer provides good performance in a thickness of about 0.2 mil. Another form of polymer useful in this invention is woven or nonwoven polymer fibers compressed into a mat of desired thickness. For example, a polymer fiber material useful in the present invention is a layer of nonwoven aramid (aromatic polyamide) fibers, commercially available as "KEVLAR" or "NOMEX" nonwoven fiber mat from E. I. Du Pont de Nemours & Company. The nonwoven aramid fiber mat of about 1.6 mils has been found to provide good performance when compressed to a thickness of 0.8 mils.

The glass materials useful in this invention are likewise glass materials which have been used as binders in variable voltage materials such as sodium silicate. As with the polymer type material, the glass material can be either coated on or formed in place on the desired substrate, such as the ground plane, or can be preformed in a sheet and assembled between the ground plane and the electrical conductor to form the device of this invention. The dielectric glass, such as a sodium silicate is generally useful in this invention in thicknesses similar to those outlined above for the polymer materials, but is also useful in some instances in thicker layers, e.g., up to about 5 mils. Further, glass fibers can be used to form the dielectric glass layer in accordance with this invention. For example, a fiberglass mat can be compressed to the desired thickness, e.g., about 1 mil or less, to provide the performance characteristics desired for a particular application in which this invention is to be used. As with the polymer fiber mat, a sheet of nonwoven or woven glass fibers can be compressed, with or without an adhesive or binder present, to the desired thickness under heat treatment to provide a result sheet of desired thickness for use in this invention.

As will be appreciated by one skilled in the art, various dielectric polymers and glasses can be used in this invention following the teachings contained herein with respect to the thickness that must be maintained for the neat dielectric polymer or glass to exhibit the desired clamping voltage and other desired properties. Examples of polymers which can be employed in this invention include those disclosed in U.S. Pat. Nos. 4,298,416, 4,483,973, 4,499,234, 4,514,529, 4,523,001, 4,554,338, 4,563,498, 4,580,794, the disclosures of which are incorporated herein by reference. As indicated, other resins may be selected for use in accordance with this invention.

In another aspect of this invention, it has been found that the above described neat dielectric polymer or glass layer can be used in combination with a variable voltage material to modify and enhance certain properties and performance characteristics of the variable voltage material. As referred to as part of this invention, the variable voltage material can be a conventional variable voltage material which comprises a binder containing conductive particles and/or semiconductive particles and/or insulative particles. As used in this invention, the variable voltage material may also include other novel, modified and improved variable voltage materials or variable voltage components such as disclosed in this specification and as disclosed in commonly assigned co-pending application Ser. No. 08/790,250 filed on an even date with this application. The neat dielectric polymer or glass layer which is used in combination with such variable voltage materials or components is placed in contact with one or both surfaces of the variable voltage material or component and can be the same neat dielectric polymer or glass referred to and described above in this application.

Figure 2:
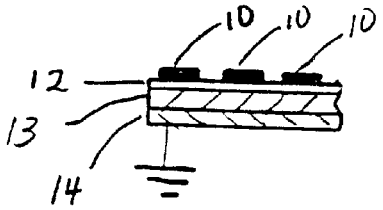
FIG. 2 is a cross-section view of an illustration of a variable voltage protection compound having a layer of variable voltage material comprising a binder and conductive particles and/or semiconductive particles in combination with a layer of neat dielectric polymer or glass.

FIG. 2 illustrates the device of this invention where neat dielectric polymer or glass layer 12 is positioned between electrical conductors 10 and variable voltage material 13. Neat dielectric polymer or glass layer 12 is distinct from variable voltage material layer 13. Ground plane 14 is provided in contact with layer 13.

In this aspect of the invention, the above-described neat dielectric polymer or glass layer can be applied to the surface of a desired variable voltage material or component as described above, for example in a liquid form and cured in place, or can be provided in a pre-cured or preformed sheet and laminated to the surface of the variable voltage material or component. It will be recognized by one skilled in the art that various conventional variable voltage materials and components can be combined with the neat dielectric polymer or glass layer as described herein to form the combination of this invention, a variable voltage material with an exterior layer of neat dielectric polymer or glass, to provide desired performance characteristics. In particular, it is preferred in this aspect of the invention to provide in combination a multi-layer product as described below and a neat dielectric polymer or glass layer on one or both exterior surfaces of such a multi-layer variable voltage component.

In another aspect this invention comprises a multi-layer variable voltage protection component which comprises at least three layers of variable voltage material which comprises a binder containing conductive and/or semiconductive particles and may optionally contain insulative particles. The multi-layer variable voltage protection component according to this invention comprises two outer layers containing a lower loading or concentration of conductive and/or semiconductive particles while the inner layer of the component contains a higher loading or concentration of conductive and/or semiconductive particles. As described above, this multi-layer variable voltage protection component can optionally further comprise on either or both surfaces of the component, a neat dielectric polymer or glass layer to further enhance or change the performance characteristics as desired.

Figure 3:
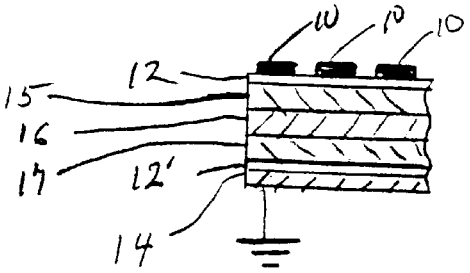
FIG. 3 is a cross section view of an illustration of a multi-layer variable voltage protection component according to this invention and incorporating optional exterior layer of neat dielectric polymer or glass.

FIG. 3 illustrates this invention where individual layers of variable voltage protection material 15, 16 and 17 form the multi-layer product positioned between electrical conductors 10 and ground plane 14. Optionally, a neat dielectric polymer or glass layer 12' can be positioned on the outside layer 15 and in contact with conductors 10 and/or neat dielectric polymer or glass layer 12 can be positioned on the outside of layer 17 and in contact with ground plane 14.

The individual layers of the multi-layer product of this invention can be formulated as conventionally disclosed in the patents referred to in the background section above or more preferably can be formulated and made by the method described herein below. In general, it is preferred that the two outside layers of the present multi-layer product contain at least about 20 percent by volume conductive and/or semiconductive particles while the inner layer contains at least about 40 percent by volume conductive or semiconductive particles in a binder. It is more preferred that the two outside layers contain at least 30 percent by volume of such particles and the inner layer contains at least about 50 percent and more preferably at least about 60 percent by volume of such particles in the binder. It is not necessary for the two outside layers of the product to contain the same loading or concentration of such particles, for example, one outside layer may contain 30 percent by volume of such particles while the other outside layer contains 40 percent and the inner layer contains 60 percent by volume of such particles in the binder. Following the teachings of this invention, it will be apparent to one skilled in the art that the concentrations or loadings of conductive and/or semiconductive particles in the various layers can be varied to obtain the performance characteristics desired. However, it will further be recognized that the teachings of this invention indicate that the exterior layers of the component contain lower particle loadings than the interior layer or layers. It will further be recognized that the inner or interior layer of this component can itself be made up of multiple layers of variable voltage materials which are higher in particle loading or concentration than the exterior surface layers.

When the first outer layer is in direct contact with the electrical conductor of the electronic device, that outer layer has a lower conductive/semiconductive particle loading than the inner layer, as outlined above, but the other outer layer is optional and can have a higher or lower particle loading than the inner layer. When the first outer layer comprises a layer of neat dielectric polymer or glass which is in contact with the electrical conductor, then the first outer layer can have a higher or lower particle loading than the inner layer and the other outer layer is optional and can have a higher or lower particle loading than the inner layer.

The thickness of each layer and the overall thickness of the multi-layer component can be determined by one skilled in the art following the present disclosure to achieve the desired performance characteristics of the component. For example, a preferred embodiment comprises a first layer of 1.0 mil containing 30 percent by volume of conductive particles, with an inner layer of 0.8 mil containing 60 percent by volume of conductive particles and a third layer of 0.7 mil containing 30 percent by volume of conductive particles. Similarly, another preferred embodiment comprises a first layer of 1.0 mil of 30 percent by volume conductive particles, an inner layer of 2 mils of 60 percent by volume conductive particles and a third layer of 0.8 mil of 30 percent by volume conductive particles. Multi-layer configurations such as these provide good performance characteristics. In addition, it will be recognized by one skilled in the art that each layer which is provided in the form of a polymeric or other dielectric binder containing the desired conductor and/or semiconductor and/or insulative particles contained therein can be applied in a liquid form and then dried or cured. The multi-layer product of this invention can be formed by applying two or more of the layers and then curing or drying all of the layers simultaneously or, alternatively, the multi-layer product of this invention can be formed by applying the first layer, for example, to a metal ground plane member, and curing or drying that layer before applying the subsequent layers. In this fashion, each layer can be applied and cured or dried to the desired thickness before the subsequent layer is applied. Thus, it will be recognized by one skilled in the art that the multi-layer variable voltage protection component according to this invention can be formed in various ways using various materials. However, a preferred embodiment is provided by employing the method described herein below for preparing the variable voltage protection material then forming the above multi-layer product of this invention in the particle loadings and the layer thicknesses as described above. It will further be recognized by one skilled in the art that each individual layer can be selected as desired such that each of the layers of the multi-layer product may be of a different type of binder materials and/or conductive or semiconductive particles provided that the basic criteria is followed in that the exterior layers of the multi-layer product contain the lower concentration or loading of conductive and/or semiconductive particles while the interior layer contains a higher loading of such particles. For example, each layer can be selected from the various conventional variable voltage materials available in the prior art which comprise a binder containing various conductive and/or semiconductive and/or insulative particles. Alternatively, it will be recognized that each layer can be individually selected to employ the novel and improved variable voltage protection materials or components as disclosed in commonly assigned co-pending application Ser. No. 08/790,250 filed on even date with this application. In this regard, the novel variable voltage materials containing, for example, the reinforcing mats as disclosed in said co-pending application, can be selected for use as particular individual layers in the multi-layer product of this invention.

The multi-layer product of this invention can be constructed such that each layer comprises a binder, such as a dielectric polymer or dielectric glass binder, containing conductive particles, such as aluminum particles, and optionally containing semiconductor particles, such as silicone carbide, and further, optionally containing insulative particles such as a fumed silica. Each of these various components are well known in the art as well as methods for forming the variable voltage materials with the binders and curing or drying the binders to form the desired final material. In this regard, the disclosures of the above-referenced patents are incorporated herein as providing the basic materials and components which can be used to make the multi-layer product according to the present invention.

Figure 4:
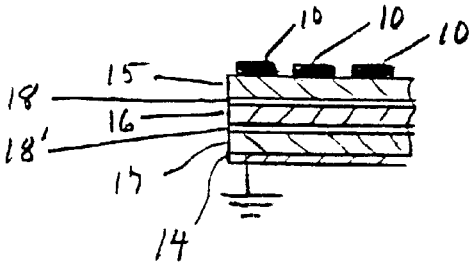
FIG. 4 is a cross-section view of an illustration of a multiple layer variable voltage protection component according to this invention incorporating optional interposed metal layers between the layers of variable voltage protection material.

FIG. 4 illustrates this invention where individual layers of variable voltage protection material 15, 16 and 17 are separated by optional metal layers 18 and 18', which together comprise the multi-layer variable voltage protection device positioned between electrical conductors 10 and ground plane 14.

In another aspect, this invention comprises an improved method of making a variable voltage protection material containing a binder and conductive particles and/or semiconductive particles in combination with insulative particles all dispersed in the binder. As mentioned above, each of these components of binder, conductive particles, semiconductive particles and insulative particles are known in the art and are described in various detail in the patents referenced above. The present aspect of this invention involves a novel method of combining these conventional materials to produce a variable voltage protection material having enhanced properties. The method of the present invention comprises a first step of dispersing the conductive and/or semiconductive particles and the desired amount of insulative particles in an organic solvent whereby the conductive/semiconductive particles and the insulative particles are thoroughly dispersed in the solvent mixture. The particles can be added to the solvent in any desired order, but it is generally preferred to disperse the conductive and/or semiconductive particles in the solvent first, then add the insulative particles. The mixture is then dried by removing the solvent by evaporation. The dried mixture of particles is usually in the form of a cake, which is then ground to a powder in a grinder. The resulting powder is then added to a dielectric polymer in a milling process to uniformly disperse the particles throughout the dielectric polymer. For example, the conductive particle can be aluminum, the semiconductive particle aluminum oxide, the insulative particle fumed silica and the solvent methyl ethyl ketone. In a preferred aspect, the method further comprises forming a first solvent mixture of just conductive particle and insulative particle, and forming second solvent mixture of semiconductor particle and insulated particle. Both mixtures are separately dried and the resulting two dry mixtures which are ground and added simultaneously to a mill to be mixed in a binder to form a desired variable voltage-protection material.

In a preferred method, the binder-particle mixture is mixed with an excess of a strong polar solvent, such as MEK, to swell the binder. This mixture is then mixed in a high speed mixer to form a viscus material similar to a pigmented paint. This final mixture can be applied as desired to form variable voltage protection components or layers by depositing the material as desired in layers of desired thickness and allowing the solvent to evaporate and allowing the binder to further cure leaving the desired layer of variable voltage protection material.

In a preferred formulation, STI Dow Corning fluorosilicone rubber (DC-LS2840) is used in combination with a STI Dow Corning polydimethylsiloxane (HA2) in a volume ration of about 4:1. This mixture is milled until it becomes uniform and essentially translucent. At that point, a mixture prepared of oxide and aluminum fumed silica particles is added to the mill. The preparation of the mixture of aluminum oxide particles and fumed silica particles is as follows. A preferred aluminum oxide particle is a 5 micron "A14" particle from Alcoa. This particle is dispersed in methyl alcohol and the particle-solvent mixture passed through a 10 micron screen. To the resulting solvent dispersion of aluminum oxide particles is added 1% by weight (based on the initial weight of the aluminum oxide) of a fumed silica particle, which is "Cabosil TS530" predispersed in methyl alcohol and mixed until evenly dispersed through the solvent mixture. The solvent is then removed through evaporation to form a cake. The dried aluminum oxide particle-Cabosil cake is then ground to a powder. A second solvent mixture of an aluminum particle designated "H10" from Alcoa, which is 10 micron particle, likewise dispersed in methyl alcohol then mixed with 17% by weight of a fumed silica, which is "Cabosil M5". As above, the H10 aluminum particles are dispersed in the methyl alcohol and screened through a 20 micron screen, then the Cabsil M5 dispersed in methyl alcohol is added to the screened H10 aluminum particles in the solvent. After mixing the solvent is evaporated to form a cake which is ground to a powder. The ratio of aluminum particles to aluminum oxide particles is about 2:1 and about 45 parts by volume of particles are mixed with about 55 parts by volume of binder. Both the aluminum and the aluminum oxide powders are added to the mill and milled into the polymer mixture. After milling for a sufficient time, such as 30 minutes to an hour, to obtain uniform mixing, the mixture is removed from the mill and mixed with methylethylketone solvent in a weight ratio of about one part solvent per part of total mix from the mill. This mixture is allowed to stand for a period of a few hours, such as overnight, in the MEK, then is mixed with a small amount such as, for example about 4% by weight of a peroxide, which is 1,1-di-t-butylperoxy-3,3,5-trimethyl cyclohexane, and 17% by weight of a crosslinking agent, which is trialylisocyanurate, wherein the weight percent is based on weight of binder. This final mixture is then mixed at low speed to assure thorough mixing then is mixed at high speed until the mixture becomes the consistency of a pigmented paint. This final variable voltage protection composition can then be coated or deposited on a ground plane or on electrical conductors or other substrates in desired patterns, the solvents are allowed to dry and the binder allowed to further cure or crosslink. The variable voltage protection material is thereby provided in the desired thickness and configuration to serve as the variable voltage protection layer or component. This composition can be used to form the multi-layer product invention disclosed above or in combination with the neat dielectric polymer or glass layer invention disclosed above.

As used in the above method aspect of this invention the organic solvent can be any solvent in which the desired particles will disperse and mix with other particles. In general the solvent can be a $C_1$ to $C_{10}$ hydrocarbon which is substituted or unsubstituted, and include straight and branch chain hydrocarbons, alcohols, aldehydes, ketones, aromatics, and the like. Examples of such solvents useful in this invention include methyl alcohol, ethyl alcohol, n- or iso-propyl alcohol, formaldehyde, methyethyl ketone, toluene, benzene, futane, pentane, the choloro/fuoro ethylenes ("Freon" solvents from Du Pont), and others. It will be recognized by one skilled in the art that a solvent that can be readily evaporated under available conditions is desirable.

As used in the above invention the conductive particles, semiconductive particles and insulative particles are conventional as set forth in the above patents incorporated by reference.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed without departing from the spirit of the present invention, and it is expressly intended that all such variations, changes and equivalents which fall within the spirit and scope of the present invention as defined in the claims be embraced thereby.

What is claimed is:

1. A variable voltage protection component for placement between a ground plane and an electronic circuit comprising:

a layer of variable voltage material comprising a binder containing conductive particles and/or semiconductive particles;

a layer of neat dielectric polymer or glass distinct from the layer of variable voltage material and in contact with one surface of the layer of variable voltage material, wherein the neat dielectric polymer or glass layer is present in a thickness of less than about 1.6 mils, and further comprising, and a layer of neat dielectric polymer or glass in contact with a second surface of the layer of variable voltage material.

2. A component according to claim 1 wherein the neat dielectric polymer or glass layer is less than about 0.8 mil.

3. A variable voltage protection component for placement between a ground plane and an electronic circuit having an electrical conductor, the component comprising:

a first layer of variable voltage protection material which is in direct contact with an electrical conductor in said electronic circuit and comprises a binder having dispersed therein at least about 20% by volume of conductive and/or semiconductive particles;

a second layer of variable voltage protection material in contact with the first layer comprising a binder having dispersed therein at least 40% by volume of conductive or semiconductive particles, a third layer of variable voltage protection material in contact with said second layer comprising a binder having dispersed therein conductive or semiconductive particles at a 20% by volume which is different than the second layer.

4. A variable voltage protection component for placement between a ground plane and an electronic circuit having an electrical conductor, the component comprising:

a layer of neat dielectric polymer or glass which is in direct contact with an electrical conductor in said electronic circuit;

a first layer of variable voltage protection material in contact with said layer of neat dielectric polymer or glass and comprises a binder having dispersed therein at least about 20% by volume of conductive or semiconductive particles; and a second layer of variable voltage protection material in contact with the first layer of variable voltage protection material comprising a binder having dispersed therein conductive and/or semiconductive particles at a 40% by volume, which volume is different than in said first layer.

5. A variable voltage protection component according to claim 4 further comprising a third layer of variable voltage protection material in contact with said second layer comprising a binder having dispersed therein conductive or semiconductive particles at a 20% by volume which is different than the second layer.

* * * * *